United States Patent [19]

Didia

[11] Patent Number: 4,574,407

[45] Date of Patent: Mar. 11, 1986

[54] PORTABLE BEAUTY BASIN VANITY

[76] Inventor: Nicholas A. Didia, 4061 Waterwheel La., Bloomfield Hills, Mich. 48013

[21] Appl. No.: 627,206

[22] Filed: Jul. 2, 1984

[51] Int. Cl.[4] ..... A47K 3/00

[52] U.S. Cl. ..... 4/559; 4/574; 4/619; 4/628

[58] Field of Search ..... 4/619, 516, 625, 628, 4/515, 518, 559, 567, 568, 605, 574; 108/25, 26, 24; 302/227; 362/136; 402/118

[56] References Cited

U.S. PATENT DOCUMENTS

| | | | |
|---|---|---|---|
| 349,875 | 9/1886 | Crocker | 4/619 |
| 2,150,483 | 3/1939 | Bantz | 4/574 |
| 2,167,795 | 8/1939 | Bantz | 4/574 |
| 2,183,441 | 12/1939 | Bantz | 4/574 |
| 3,068,491 | 12/1962 | Perekrestenko | 4/516 |
| 3,213,565 | 10/1965 | Grosz | 4/559 X |
| 3,453,665 | 7/1969 | Cokic et al. | 4/625 |
| 3,591,871 | 7/1971 | Segal | 4/628 |
| 3,611,450 | 10/1971 | Bost | 4/628 |
| 3,828,695 | 8/1974 | Skanky | 108/26 |
| 4,437,714 | 3/1984 | Struck | 108/25 X |
| 4,472,843 | 9/1984 | Chermak | 4/559 |

*Primary Examiner*—Henry K. Artis

*Attorney, Agent, or Firm*—Fisher, Crampton, Groh and McGuire

[57] ABSTRACT

A portable beauty basin vanity for use in any location having a deck, side walls and end walls so as to form a cup-shaped body. The deck surface is equipped with a centrally located basin having a drain therethrough and equipped with a stopper means to selectively retain water within the basin or allow the operator to empty used wash water and refill the basin as desired. The deck surface is further equipped with various recesses to store and dispense various creams, lotions, soaps and washcloths. A detachable water spray apparatus is also provided having a spray head attachment and a tube means detachably secured at the other end to a water source. The spray head has means to control the flow of water and is detachably secured to the deck portion in close proximity to the basin by any suitable attachment means whereby the operator may dispense water in any direction as desired. A mirror is further provided pivotally secured to the deck portion to aid the operator on the application of creams, lotions or in washing or shaving. The vanity is particularly adapted for use in a bathtub setting, however, can be used for convalescent or sedentary patients whose access to bathing facilities is limited.

11 Claims, 2 Drawing Figures

PORTABLE BEAUTY BASIN VANITY

This invention relates to a portable beauty basin vanity for use in any location and particularly adapted for use in a bathtub whereby the basin serves as a convenient storage facility for various creams and lotions for use by the bather and provides means whereby the operator is provided with an alternative source of water for washing his face during bathing without having to use the common bath water.

The portable beauty vanity of the present invention is also adapted for use in any location convenient to the operator so that a convalescing patient or elderly operator need not leave the area in which he is convalescing in order to attend to personal hygiene. Rather, the present invention is adaptable so that clean water and all the articles necessary for the maintenance of personal hygiene are presented for ease and convenience of use.

The beauty basin vanity of the present invention is also adapted for the use in a bathtub and allows the operator to position the vanity at any point along the length of the bathtub.

Weiler, U.S. Pat. No. 1,944,049 relates to a cabinet for containing all the necessary articles for use in shaving while in the bathtub and constructed so that it may be held in position for use while a party is shaving while seated in the bathtub. Weiler provides for a cabinet having a mirror and spaces for various shaving articles which is affixed to an expandable, retractable cross-member which fits across the width of the tub and holds the shaving cabinet of Wyler in place for the user.

Weiler differs from the present invention in that no provision is made for using clean water from the tap to aid the user and the present invention is not an expandable, retractable unit as Weiler. Thus, the present invention differs from Weiler.

Kiss, U.S. Pat. No. 3,239,850 relates to a book rest and vanity for bathtubs. Specifically, there is provided a body member having various receptacles for creams or other articles and having hinged end members adapted to lie on the rim of the bathtub. A mirror is provided much as in the present case to aid the user in applying the creams.

Kiss differs from the present invention in that the portion adaptable to lie along the rim of the bathtub is hinged and molded so as to conform exactly with the rim of the bathtub. Morover, there is no provision in Kiss for clean water to be readily available to the user. Finally, the Kiss concept provides that the joint is adjustable according to the needs of the user. Thus, the present invention differs from Kiss.

Chapman, U.S. Pat. No. 4,053,954 relates to a frame structure to form a shelf for use in the bathtub. The shelf of Chapman has various areas for shampoos and a towel rack as well as areas for soaps. However, there is no provision for clean water to be used while the operator is seated in the bathtub and no mirror is provided. Further, the construction of Chapman differs greatly from the present invention. Thus, the present invention differs from Chapman.

The present invention is a portable beauty basin vanity for use in any location, and adaptable for use in a bathtub. The vanity of the present invention is constructed as a one-piece high impact durable plastic material and is equipped with various recesses along its deck surface for dispensing various soaps, creams and lotions. Moreover, a basin having a stopper means is provided along with a spray shower head detachably connected to a source of tap water whereby the operator may, while seated in a bathtub, fill the basin with clean tap water to wash his face without resorting to the common bath water. When clean water is desired, the stopper means is removed, the water runs out of the basin, the operator then replaces the stopper means and refills the basin via the spray head attachment. Further, this attachment is adaptable to be detached from the vanity of the present invention so that the user may direct it spray to his face or head without having to change position in the bathtub.

Figure 1:
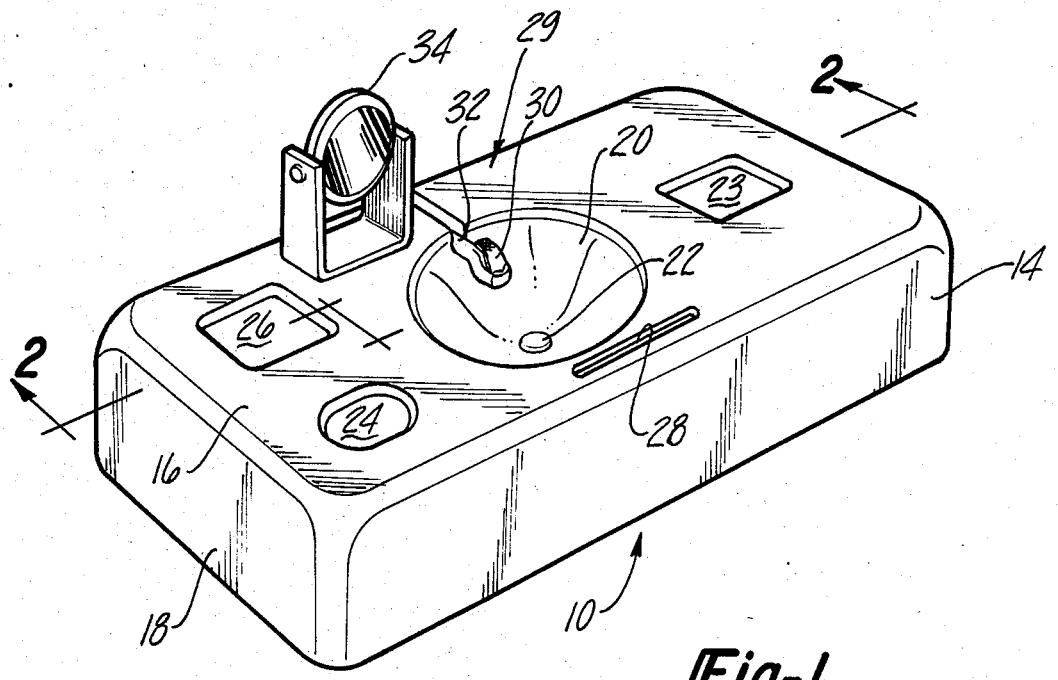
FIG. 1 is a perspective view of the bathtub vanity of the present invention showing its configuration and construction.

As seen in FIG. 1, bathtub vanity 10 of the present invention comprises a body portion 12 having side walls 14, a deck surface 16 and end walls 18 and is preferably composed of a durable material such as plastic.

Deck 16 is provided with a basin 20 to hold wash water while the beauty basin vanity of the present invention is in use. The basin is equipped with a drain 22 and a drain stopper means 24 whereby it is possible to selectively retain or drain water in the basin as dictated by the needs of the user. Receptacles 23, 24 and 26 are also provided in the deck of the beauty basin vanity and are used to hold various creams, lotions and soaps which may be needed by the user. Although only three such receptacles are shown, it is contemplated that any number of receptacles may be provided to accommodate the needs of the user. Each receptacle is preferably shaped to conform to the container from which the various creams and lotions are to be dispensed and a soap dish is provided which conforms to a conventional bar of soap.

Washcloth receptacle 28 is provided in close proximity to the wash basin and between the wash basin and the side wall 14. The receptacle is provided so that the operator may have a place to store his washcloth which is to be used to wash his face which is conveniently located and so as not to force the operator to place the washcloth on the deck surface itself where it could be inadvertently dislodged into the common bath water.

A flexible showerhead apparatus 29 comprised of a head portion 30 and a flexible tube portion 32 is provided in close proximity to the water basin of the present invention. The showerhead apparatus is adaptable to be detachably secured to the deck portion by any attachment means, and in this case is indicated by the retaining recess 34. The showerhead portion of the shower spray apparatus is provided with means to control the flow of water such as is conventional with such spray heads. The water spray apparatus has sufficient tubes so that an operator may detach the apparatus from the deck and direct its spray to any portion of his body.

A mirror is provided on the deck surface in close proximity to the basin and pivotally secured thereto so as to allow the user to position the mirror in any convenient manner to facilitate the application of creams and lotions or shaving. The mirror is preferably of the non-fogging type and may be such as to present two faces to the user, one face being a conventional mirror whereas the other face may present a magnified view such as a barber's mirror.

Figure 2:
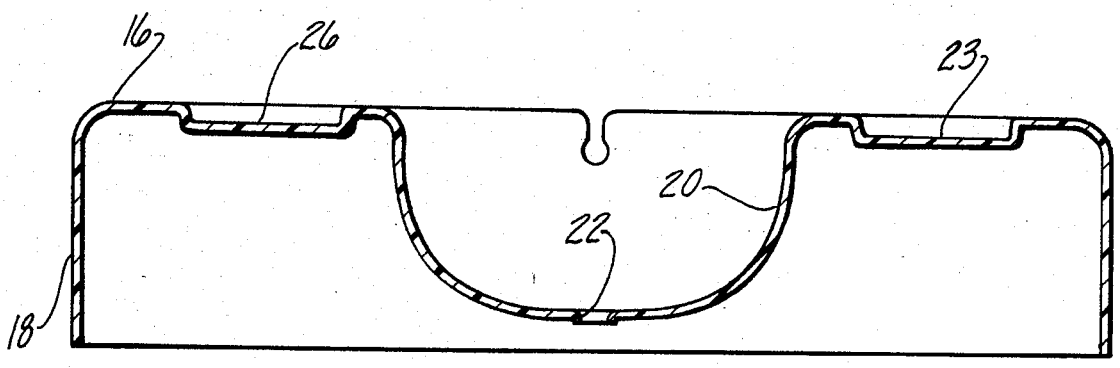
FIG. 2 is a cut-away side view taken along line 2—2 of FIG. 1 showing the bathtub vanity of the present invention.

Referring to FIG. 2, there is shown a cut-away side view of the beauty basin vanity of the present invention showing its cup-shaped structure and means for retaining itself in place while in use in a bathtub. Specifically, as can be seen in FIG. 2, the entire structure is hollow cup-shaped. The dimensions of the invention may vary, however, it is contemplated that the length of the beauty basin vanity of the present invention be such a dimension as to conform with any bathtub width so that by placing the vanity across the width of the bathtub, the vanity will stay in place and be presented for use by the user. The vanity is further adapted so that it may be placed in any location on the tub and be slid back and forth along the length of the bathtub while the user is seated in the tub. It is contemplated that the vanity of the present invention be constructed of a durable high-impact, low maintenance material such as a plastic or fiberglass to present an easy to care for long-life article for use in the maintenance of personal hygiene.

It is further contemplated that the present invention need not be restricted for use in a bathtub. Rather, it may serve as a portable vanity for use with convalescent or sedentary patients whose access to bathing facilities is limited.

In operation, the various recesses are provided with soaps, creams and lotions and a washcloth is provided in the receptacle so designated. The water spray apparatus is connected to a source of water and the basin may be filled with water. When the user is through with the water contained in the basin, the stopper means is removed from the drain and the water is allowed to pour out. When it is desired to selectively direct the flow of water onto a portion of the user's body, the water spray apparatus may be detached from its place on the deck and the spray of water may then be directed to any portion desired.

While a specific embodiment of the invention has been shown and described, it is to be understood that numerous changes and modifications may be made without departing from the scope and spirit of the invention.

The embodiments of the invention in which an exclusive property or privilege is claimed are defined as follows:

1. A portable beauty basin vanity for use in any location, said vanity comprised of: a body portion having a deck, side walls and end walls to form an inverted cup-shaped body, said deck surface equipped with a centrally located basin having an aperture therethrough and equipped with a stopper means to selectively retain water within the basin and allow an operator to empty used wash water and refill the basin with clean water, said deck surface further equipped with various recesses along its surface to store and dispense various creams, lotions, soaps and a washcloth, a detachable water spray apparatus for dispensing water where desired, said water spray apparatus having a spray head attachment at one end and means detachably securable at said other end to a water source, said spray head detachably secured to said deck portion in close proximity to said basin by attachment means whereby said operator may dispense water into said basin as desired; and a mirror means attached to said deck surface to aid the operator in application of said creams, lotions or in washing, whereby said beauty basin vanity may be provided with various creams, lotions, soaps and wash cloths and used in any location convenient to aid said operator in maintaining personal hygiene and in the application of said creams and lotions.

2. The beauty basin vanity of claim 1 wherein said vanity is adaptable for use in a bathtub whereby the operator is presented with an alternative supply to wash her face other than the common bathtub water.

3. The beauty basin vanity of claim 2 wherein said cup-shaped body further allows the operator to position the vanity at any point along the length of said bathtub.

4. The beauty basin vanity of claim 1 wherein said attachment means for said sprayer head is a recess formed in the deck of said body portion of said vanity to detachably receive such sprayer head.

5. The beauty basin vanity of claim 1 wherein said mirror is pivotally secured to said deck surface to allow the operator to adjust said mirror to any desired position.

6. The beauty basin vanity of claim 1 wherein said mirror has two reflective surfaces, whereby the operator may select whether to view a life size reflection or a magnified reflection.

7. The beauty basin vanity of claim 1 wherein said recesses for creams and lotions are shaped to conform to the containers from which said creams and lotions are dispensed, and said recess for said soap is shaped to conform to a conventional bar of soap.

8. The beauty basin vanity of claim 1 wherein the recess for a washcloth is located in close proximity to said basin.

9. The beauty basin vanity of claim 1 wherein said vanity is comprised of a lightweight, low maintenance material.

10. The beauty basin vanity of claim 10 wherein said vanity is comprised of a high impact, durable plastic material.

11. The beauty basin vanity of claim 1 wherein said mirror is of the non-fogging type.

* * * * *